US006435505B1

(12) United States Patent
Hoffman

(10) Patent No.: US 6,435,505 B1
(45) Date of Patent: Aug. 20, 2002

(54) METHOD FOR PLAYING A GAME OF CHANCE

(76) Inventor: Arthur Hoffman, 90 Main St. Unit 1A, Woodbridge, NJ (US) 07095

( * ) Notice: Subject to any disclaimer, the term of this patent is extended or adjusted under 35 U.S.C. 154(b) by 0 days.

(21) Appl. No.: 09/837,600

(22) Filed: Apr. 19, 2001

(51) Int. Cl.[7] ..... A63F 3/08
(52) U.S. Cl. ..... 273/274; 273/146; 463/22
(58) Field of Search ..... 273/274, 292, 273/146, 268; 463/11, 13, 22

(56) References Cited

U.S. PATENT DOCUMENTS 5,556,101 A * 9/1996 Jabro ..... 273/145 E
5,573,248 A * 11/1996 Parra et al. ..... 273/145 C
5,662,330 A * 9/1997 Spears ..... 273/274
5,964,463 A * 10/1999 Moore, Jr. ..... 273/274
6,286,834 B1 * 9/2001 Caputo ..... 273/146

* cited by examiner

*Primary Examiner*—Benjamin H. Layno
*Assistant Examiner*—Vishu K Mendiratta
(74) *Attorney, Agent, or Firm*—Thomas L. Adams

(57) ABSTRACT

A method for allowing at least one player to play a game of chance against a house, such as a casino. The method includes the step of allocating a predetermined number of indicia to the house and to the at least one player by chance. These indicia may be obtained by rolling dice, but other processes are contemplated. More indicia are allocated to the at least one player than to the house. The method also includes the step of applying ordinary values to the indicia allocated to the house. Another step is applying the ordinary values to the indicia allocated to the at least one player, unless one or more exceptions are invoked under a predetermined devaluation rule. Another step is declaring the at least one player a winner if the values applied to the indicia allocated to the at least one player after invoking the predetermined devaluation rule, exceed in total the ordinary values applied to the indicia allocated to the house.

29 Claims, 1 Drawing Sheet

METHOD FOR PLAYING A GAME OF CHANCE

BACKGROUND OF THE INVENTION

1. Field of the Invention

The present invention relates to games of chance, and in particular, to games played against a house, such as a casino.

2. Description of Related Art

The gaming industry has become relatively competitive and casinos concentrated in certain jurisdictions seek to offer games of chance that are most likely to attract gamblers. Successful games pit one or more players against a house and are simple to understand. It is also desirable to use simple gaming equipment, not only to moderate costs, but also to instill a sense that the game is fair.

Also, a game should be playable in relatively brief betting rounds, so that money circulates quickly, thereby offering a high potential for profit. It is also desirable to offer participants the option of placing side bets not only on the main game, but on some subsidiary outcomes of the game.

The popularity of a game greatly depends on the player's estimation of his or her chance to win. This estimation is affected not only by the mathematical odds, but by a sense of who has an advantage in a specific gaming environment. For example, the "pick six" lotteries represent very difficult odds mathematically, but the notion of picking six numbers correctly does not seem difficult intuitively. Also, active participation gives a player a sense of control and a feeling that the chance of winning is better. With a wheel of fortune or roulette the player simply observes a random process; but a shooter shooting craps is an integral part of this process. Moreover, a craps shooter has a sense of competitive involvement.

In U.S. Pat. No. 5,513,850 a dealer initially rolls four dice and the player then rolls other dice repeatedly, getting credit for certain numbers according to predetermined rules. Once the player's turn is completed, the dealer rolls two more dice and the winner is determined according to the scoring rules. This game is a rather complex and does not give the player the feeling of having a special advantage.

In U.S. Pat. Nos. 5,490,670 and 5,785,596 a series of numbers are displayed by a computer or other means at the beginning of a round of craps. Players betting on whether the successive rolls of the shooter will match the series of numbers can be entitled to a large jackpot payoff. This reference simply incorporates another side bet in a well-known game and does not establish a new game with a different environment.

In U.S. Pat. No. 5,662,330 three dice are rolled and players bet whether the number rolled is high or low; specifically, less than 16 or greater than 19. Players of this game tend to act as passive observers and do not develop a sense of competitive involvement. In U.S. Pat. No. 5,350,175 wagers can be placed on numbers obtained from more than one roll of the dice. Again, the players do not develop a sense of competitive involvement.

In U.S. Pat. No. 5,573,248 three dice are simultaneously rolled, and a designated pair of the trio is used for playing craps. Players may also bet on whether all three dice will have matching numbers. This reference is a variation of a well-known game and not establish a new competitive game environment.

See also U.S. Pat. No. 6,059,658 (wheel of fortune with specific markings may be combined with rotating reels, as commonly used in slot machines); U.S. Pat. No. 6,070,872 (roll of die determines whether certain playing cards are turned face up); U.S. Pat. No. 5,964,463 (in modified craps game players can place wagers before play begins, which may consist of four rolls of the dice by the shooter); and U.S. Pat. No. 4,826,170 (box has compartments, some of which contain dice).

Accordingly, there is indeed for a new and simple game of chance that establishes an environment where players develop a sense of involvement and a feeling that they have certain competitive advantages.

SUMMARY OF THE INVENTION

In accordance with the illustrative embodiments demonstrating features and advantages of the present invention, there is provided a method for allowing at least one player to play a game of chance against a house. The method includes the step of allocating a predetermined number of indicia to the house and to the at least one player by chance. More indicia are allocated to the at least one player than to the house. The method also includes the step of applying ordinary values to the indicia allocated to the house. Another step is applying the ordinary values to the indicia allocated to the at least one player, unless one or more exceptions are invoked under a predetermined devaluation rule. Another step is declaring the at least one player a winner if the values applied to the indicia allocated to the at least one player after invoking the predetermined devaluation rule, exceed in total the ordinary values applied to the indicia allocated to the house.

By employing methods in accordance with the foregoing, a game of chance can be established that gives players a sense of involvement as well as a sense of a competitive advantage. In a preferred embodiment, play starts when the house rolls dice, followed by a roll of different dice by a player. Preferably, the house rolls four dice and the player rolls five dice, although different numbers of dice may be used in other instances. The fact that the player rolls more dice delivers a sense of a competitive advantage.

Although the player rolls toward dice, some faces of the dice are devalued in this preferred embodiment. In one instance, any of the dice rolled by the player that show a face with the "five" indicia will be devalued to zero. Therefore to win this game, the player after invoking the devaluation rules must achieve a sum that exceeds the sum of the house dice applying ordinary values.

Preferably, additional side bets can be placed by participants who can wager in favor of the house and the player. Side bets can also be placed on special outcomes. For example in a preferred embodiment, one can wager that all of the dice rolled by the house will match, or that all but one will match. Also, one can bet that the house dice will be at least some upper value, or no more than some lower value, in this preferred embodiment. One can also bet on a "push" or tie.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figures 1, 2:
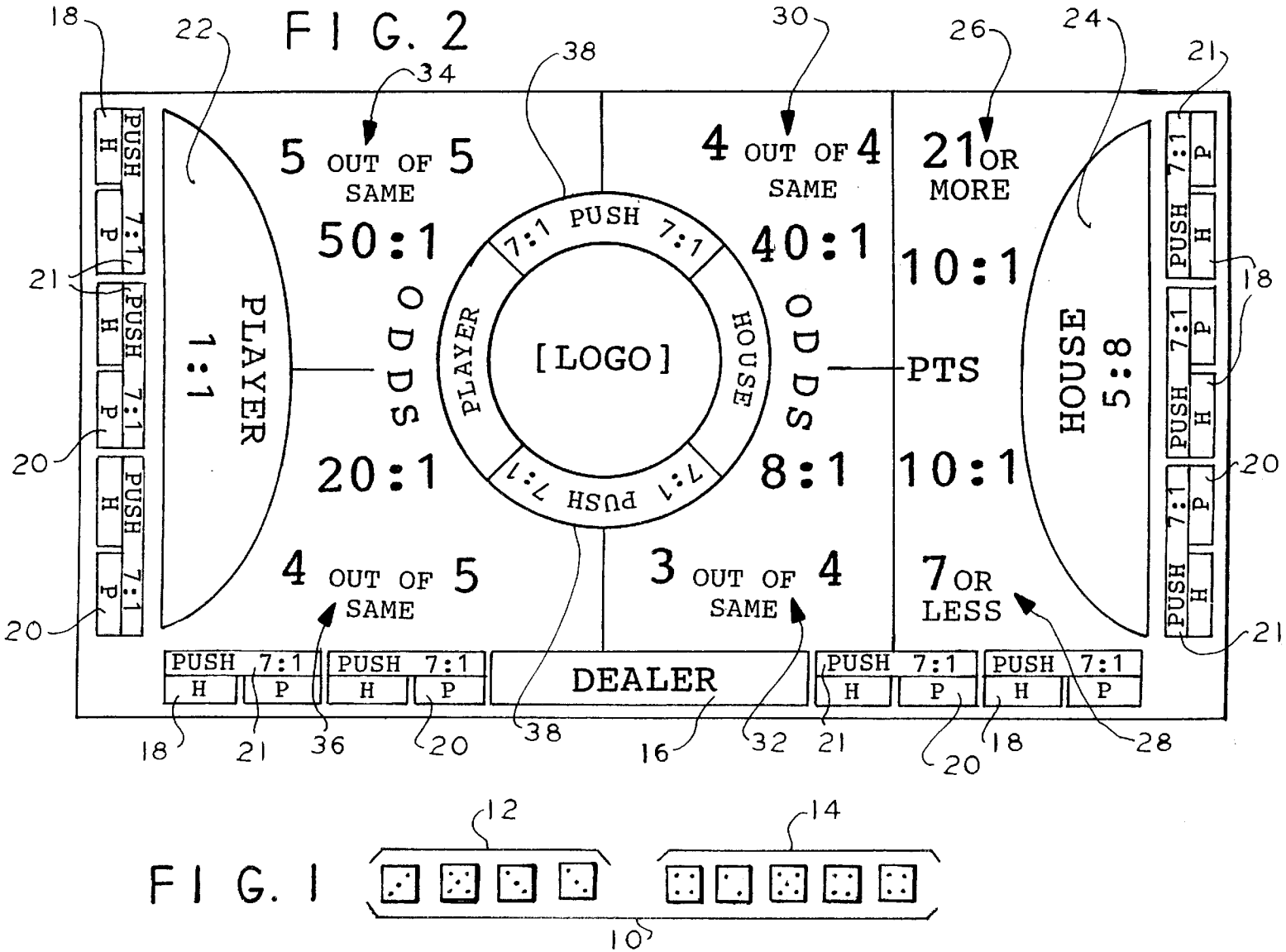
FIG. 1 is an elevational view of dice that may be used in a gaming method in accordance with principles of the present invention.
FIG. 2 is a plan view of a board used in connection with this gaming method.

Referring to FIG. 1, the preferred game of chance is played with nine dice 10, four of the dice 12 allocated to the house and five of the dice allocated to a player who will roll those five dice. As explained further hereinafter, the game can be played with a greater or lesser number of dice, but preferably the player has at least one more die than the house.

The dice may be conventional solid cubes, but in other embodiments may be electronic equipment that randomly (or pseudo-randomly) allocates numbers. In still other embodiments the dice may be replaced with traditional playing cards, and the picture cards, if used, may be assigned sequentially higher values (e.g., 10, 11, and 12), or some other value. Other devices may be used for allocating numbers or other indicia by chance (for example, air chambers for mixing numbered ping pong balls and driving one into an output conduit). Preferably however, each indicia will be selected from any one of n predetermined symbols.

A simple game may be played with one party rolling the four dice 12. In the example shown in FIG. 1 the ordinary values of the dice 12 are: 3, 5, 3, and 3. Accordingly, this roll of four dice 12 will be assigned a total value of 14, using the ordinary values marked on the dice. The next party will roll the five dice 14. In the example of FIG. 1 the ordinary values of the dice 14 are: 4, 2, 5, 4, and 4. If ordinary values were assigned, this roll of five dice 14 would be assigned a total value of 19. However, this game is played with a predetermined devaluation rule. In this instance any of the dice 14 displaying the "five" indicia will be subject to an exception and will be assigned the value of zero. Accordingly, the illustrated roll of dice 14 will be assigned a devaluated total value of 14. Therefore, the assigned total values for dice 12 and 14 are the same.

While the foregoing game can be played between two parties without wagering, the present invention contemplates more extensive use and preferably use by a casino acting as a house, which allows wagers by at least one player.

Referring to FIG. 2, a gaming table is illustrated for facilitating games where one party acts as a house to facilitate wagers by at least one player who will roll dice and by other participants (in this sense the player rolling the dice may also be considered a "participant). This table is arranged to allow one party, designated a "dealer," to stand in front at position 16 in order to roll four dice (for example, dice 12 of FIG. 1) on behalf of the house. Casino patrons may stand or sit in front alongside dealer position 16 or along the two adjacent sides. Essentially, these casino patrons will stand or sit next to the betting boxes 18, 20 and 21. Boxes 18 will be marked with the letter H, while boxes 20 are marked with the letter P, to indicate a house or player bet, as will be described presently. Boxes 21, which sit atop and straddle a pair of boxes 18 and 20, are marked "PUSH 7:1", to indicate a push bet, as will also be described presently.

For each betting round, one of the patrons will be designated the player who will roll the dice and play against the house. Play begins with the dealer rolling the four dice 12 (FIG. 1), followed by the designated player rolling the five dice 14. The dice may be rolled from a cup to a location in front of the roller, or by hand across the table. In this embodiment there is only one player rolling dice against the house, but in other versions of the game there may be two or more players rolling dice against the house.

As described above, the house's four dice 12 will be assigned their ordinary values while the player's five dice 14 will be assigned ordinary values, except for the face value "five," which will be devalued to zero. As explained further hereinafter, other predetermined devaluation rules are possible within the scope of the present invention.

Before the house or player roll their respective dice, the player and other participants may place bets. A wager that the house will win is made by placing a chip or other marker on one of the boxes 18. A wager that the player will win is made by placing a chip or other marker on one of the boxes 20. Wagers may be made by the player who is rolling the dice 14 or by one of the other participants standing or sitting alongside the table of FIG. 2.

An interesting aspect of the game is the advantage held by the player due to the fact that the player is rolling an additional die. This advantage is offset by the fact that certain indicia on the player's dice will be devalued. Specifically, the indicia "five" will be assigned the value zero. To determine the net effect of such advantage and disadvantage, one must evaluate the probability of winning.

The probability of winning is determined by summing the probabilities of every combination of winning outcomes. If $P_n$ is the probability of a player rolling dice valued at n, and $H_m$ is the probability of the house rolling dice valued at m, then the probability (W) of the player winning is:

$$W = \sum_{n=5}^{30} P_n \sum_{m=4}^{n-1} H_m \quad m \leq 24$$

If $T_p$ and $T_n$ are the total number of distinct outcomes for the player and house, respectively, and if $Np_n$ represents the number of ways the player can make n, and $Nh_m$ represents the number of ways the house can make m, then $P_n = NP_n/T_p$, and $Hm = Nh_m/T_h$. Therefore:

$$W(T_p T_h) = \sum_{n=5}^{30} Np_n \sum_{m=4}^{n-1} Nh_m \quad m \leq 24$$

For the four and five dice example, $T_h = 6^4$, and $T_p = 6^5$. Therefore, the probability of winning W (player achieving a greater total) can be calculated if one can calculate the probability of the discrete outcomes for the rolls of the dice, i.e., if one can calculate the values of $NP_n$ and $Nh_m$. These values are tabulated below:

| Dice Sum (d) | Ways House Can Make Sum ($Nh_d$) | Ways Player Can Make Sum ($Np_d$) | Ways Player Can Win With Sum |
|---|---|---|---|
| ≦4 | 1 | 126 | 0 |
| 5 | 4 | 121 | 121 |
| 6 | 10 | 190 | 950 |
| 7 | 20 | 275 | 4125 |
| 8 | 35 | 370 | 12950 |
| 9 | 56 | 465 | 32550 |
| 10 | 80 | 556 | 70056 |
| 11 | 104 | 625 | 128750 |
| 12 | 125 | 670 | 207700 |

-continued

| Dice Sum (d) | Ways House Can Make Sum ($Nh_d$) | Ways Player Can Make Sum ($Np_d$) | Ways Player Can Win With Sum |
|---|---|---|---|
| 13 | 140 | 685 | 297975 |
| 14 | 146 | 670 | 385250 |
| 15 | 140 | 621 | 447741 |
| 16 | 125 | 560 | 482160 |
| 17 | 104 | 475 | 468350 |
| 18 | 80 | 390 | 425100 |
| 19 | 56 | 305 | 356850 |
| 20 | 35 | 231 | 283206 |
| 21 | 20 | 160 | 201760 |
| 22 | 10 | 115 | 147315 |
| 23 | 4 | 70 | 90370 |
| 24 | 1 | 45 | 58275 |
| 25 | | 25 | 32400 |
| 26 | | 15 | 19440 |
| 27 | | 5 | 6480 |
| 28 | | 5 | 6480 |
| 29 | | 0 | 0 |
| 30 | | 1 | 1296 |
| TOTAL | 1296 ($6^4$) | 7776 ($6^5$) | 4167650 ($WT_pT_h$) |

By dividing the total for the last column (4,167,650) by $6^4$ and $6^5$, the probability W of the player winning by getting a greater total than the house is calculated to be 0.4135 (rounded). Thus, the player will win slightly more than four out of ten times.

The table layout of FIG. 2 shows at location 22 betting odds of 1:1 for a wager that the player rolling the five dice 14 (FIG. 1) will win. Specifically, a participant placing a one dollar bet on the player will win one dollar if the player wins. In the event of a tie, the participant will lose this bet. Since the odds of the player winning (with ties considered a loss) are 0.4135, the house maintains a statistical advantage so that the game is commercially feasible. For a participant placing a wager that the house will win, the table layout shows at location 24 odds of 5:8, that is, the participant will win five dollars on an eight dollar bet. For this bet, a tie is considered a "push" and no money is either lost or won. The house still maintains a statistical advantage with these bets in favor of the house (probability should be adjusted for the different outcome on ties) so that the game remains commercially feasible.

The present game method can be played with a variety of side bets. Location 26 show odds of 10:1 on bets that the total of the house dice will be at least 21 (at least a predetermined sum). Location 28 show odds of 10:1 on bets that the total of the house dice will be no more than 7 (no more than a predetermined sum). In the example of FIG. 1, the house's dice 12 fall between 7 and 21 and therefore a bet on location 26 or 28 will be a losing bet. To avoid confusion similar bets will not be taken with respect to the player's dice 14, since parties may be unsure whether the predetermined devaluation rules apply.

Location 30 shows odds of 40:1 on bets that the all of the indicia on the house's dice will match. Location 32 shows odds of 8:1 on bets that the all but one of the indicia on the house's dice will match. In the example of FIG. 1 three of the house's dice 12 match, so that a bet at location 32 is a winning bet, while a bet at location 30 is a losing bet.

Location 34 shows odds of 50:1 on bets that the all of the indicia on the player's dice will match. Location 36 shows odds of 20;1 on bets that the all but one of the indicia on the player's dice will match. The bets of locations 34 and 36 are conducted without regard to devaluation rules. In the example of FIG. 1 only three of the player's dice 14 match, so that a bets at location 34 or 36 are losing bets.

Locations 21 and 38 show odds of 7:1 for a "push." A party playing this bet will win in the event of a tie, that is, if the total of the values of the indicia on the player's dice, after invoking the predetermined devaluation rule, equals the total of the ordinary values of the indicia on the house's dice. In the context of the present embodiment, a push means that the sum of the numbers rolled by the player (after setting "five" to to zero) equals the sum of the numbers rolled by the house. In the example of FIG. 1 the house's dice 12 in the player's dice 14 are both assigned the value of fourteen. Because of this tie, a bet placed at location 21 or 38 will be a winning bet.

All of the foregoing bets are placed before any dice are rolled by placing chips or other markers at the locations 18, 20, 21, 26, 28, 30, 32, 34, 36, and 38. The player rolling the dice or other participants can place bets at one location, at all locations or in any pattern at only some of the locations. In this embodiment, it is mandatory that the player rolling the dice place at least one bet on the house (location 18), the player (location 20), or on a push (location 21 or 38). Other participants who are not rolling the dice will not need to make that mandatory bet. In any event, persons employed by the house will be stationed on the side of the table opposite dealer location 16 in order to keep track of the bets placed, to take in the losses, and to pay the winners.

To facilitate gambling by patrons, a casino may post, distribute, or explain the rules of the game as follows:

The object of the game is for the casino to roll their set of dice and the player rolls their set of dice; who ever scores the highest denominator wins. However, the Casino gets four dice to roll at one time and the player gets five dice to roll at the same time. However, all the 5's on the PLAYER'S set of dice equal to the amount of zero. All the other numbers on both sets of dice equal to the same amount of points according to their face value. The dealer rolls first and then the players roll. After the PLAYER and the CASINO establishes who has won, and all the payouts have been made, the dice on the PLAYER'S side will be passed to the next player whose turn it is. All new bets are to be made once again. All bets are made and played on each individual rollout.

The players can either bet on the PLAYER'S roll of the dice or the CASINO'S roll of the dice. If the player bets on the PLAYER'S rollout the payout is 1:1, Even odds. If the player bets with the CASINO'S rollout they then must layout $8 to win $5. $8 is a minimum bet when you are betting with the house because the payout is 5:8 odds.

Push/Ties: In the case when a tie occurs the player is capable of making a straight up bet on a tie. The payout would be 7:1 odds for every dollar bet by the player (on a push/tie bet ) the player receives $7 for every dollar they lay out on a tie. If the player bets on the PLAYER'S rollout, and a tie occurs, they lose their bet. If the player bets on the CASINO'S rollout, and a tie occurs, then a tie is a push (nobody wins nobody loses).

The player always has the option to make side bets without having to bet on the PLAYER'S side to win or the CASINO'S side to win, but they can only do this when someone else is rolling the dice. If the Person who rolls the dice, is to establish a roll against the house/casino, the one who is rolling must make a bet on either the PLAYER to win, the CASINO to win, or on the "PUSH" bet. They must make at least one of those bets if they wish to roll the dice themselves.

The player can make side bets on whether the CASINO rolls 4 of the same like dice to come out when the CASINO establishes their roll. The payout for this bet would be 40:1 . For every dollar the player lays out on this particular bet the casino will pay the player $40.

The player can bet whether at least 3 out of the four dice come out the same on the CASINO'S rollout. The odds are 8:1 for every dollar laid out on this particular bet by the player the Casino will pay them $8.

The player can bet on whether the roll of the CASINO'S dice will add up to 21 or more this particular bet pays out to the player 10:1 odds.

The player can also bet whether the roll of the CASINO'S dice will roll out to 7 or less. this to also will pay out 10:1 odds for every dollar the player lays out on this bet.

The player has the option to make side bets on the PLAYER'S rollout of the dice. If 5 of the same like dice are rolled out on the PLAYER'S roll of the dice the Casino will pay the player 50:1 odds for every dollar that is laid out by the player.

If the player rolls at least 4 of the same like dice on their rollout the Casino will pay them 20:1 odds for every dollar laid out by the player on this particular bet. (Don't forget the Player rolls 5 dice not 4)

All bets are made before the roll of any dice.

All bets are paid out after both the CASINO and the PLAYER'S roll of the dice are complete.

It is appreciated that various modifications may be implemented with respect to the above described, preferred embodiment. As noted previously, a different number of dice may be used and the player may have two or more dice more than the house. Furthermore, dice need not be used in some embodiments. Moreover, the game can be played in a casino or as part of a home board game without wagering. Also, instead of setting the "five" indicia to zero, one or more indicia other than the "five" indicia may be affected. Also, the effect of may be to reduce the value but not to zero. In some embodiments some indicia may be increased in value. Alternatively, some predetermined combinations of indicia may be assigned an increased or decreased net value. Additional side bets may be allowed, such as a bet that the house or player will roll a specific total or a specific combination. Also, the order in which dice are thrown may be varied, and in some cases all dice will be thrown simultaneously.

Obviously, many modifications and variations of the present invention are possible in light of the above teachings. It is therefore to be understood that within the scope of the appended claims, the invention may be practiced otherwise than as specifically described.

What is claimed is:

1. A method for allowing at least one player to play a game of chance against a house, comprising the steps of:

allocating a predetermined number of indicia to the house and to the at least one player by chance, more indicia being allocated to the at least one player than to the house;

applying ordinary values to the indicia allocated to the house;

applying the ordinary values to the indicia allocated to the at least one player unless one or more exceptions are invoked under a predetermined devaluation rule;

declaring the at least one player a winner if the values applied to the indicia allocated to the at least one player after invoking the predetermined devaluation rule, exceed in total the ordinary values applied to the indicia allocated to the house.

2. A method according to claim 1 wherein the at least one player is allocated one more indicia than the house.

3. A method according to claim 1 wherein the predetermined devaluation rule applies a below nominal value to a predetermined one of the indicia.

4. A method according to claim 3 wherein the below nominal value is zero.

5. A method according to claim 3 wherein each allocated indicia can be any one of n predetermined symbols.

6. A method according to claim 5 wherein the n predetermined symbols are distinct and have ordered values.

7. A method according to claim 1 wherein the step of allocating indicia is performed by:

electronically selecting a predetermined number of indicia for the house: and electronically selecting a greater number of indicia for the at least one player.

8. A method according to claim 1 wherein the step of allocating indicia is performed by:

rolling a predetermined number of dice for the house: and rolling a greater number of dice for the at least one player.

9. A method according to claim 8 wherein the predetermined devaluation rule applies a below nominal value to a predetermined face of each die.

10. A method according to claim 9 wherein the predetermined face is marked with a value of five and is devalued to zero by the predetermined devaluation rule.

11. A method according to claim 1 comprising:

permitting at least one participant to wager on the outcome of said step of allocating a predetermined number of indicia to the house and to the at least one player.

12. A method according to claim 11 wherein the at least one participant can wager that the house will win or can wager that the at least one player will win.

13. A method according to claim 11 wherein the at least one participant can wager that the indicia allocated to the house will total at least a predetermined sum.

14. A method according to claim 11 wherein the at least one participant can wager that the indicia allocated to the house will total no more than a predetermined sum.

15. A method according to claim 11 wherein the at least one participant can separately wager that:

(a) all of the indicia allocated to the house will match, (b) all but one of the indicia allocated to the house will match, (c) all of the indicia allocated to the at least one player will match, or (d) all but one of the indicia allocated to the at least one player will match.

16. A method according to claim 11 wherein the at least one participant can separately wager that the values applied to the indicia allocated to the at least one player after invoking the predetermined devaluation rule, will equal in total the ordinary values applied to the indicia allocated to the house.

17. A method according to claim 11 wherein the step of allocating indicia is performed by:

rolling a predetermined number of dice for the house: and rolling a greater number of dice for the at least one player.

18. A method according to claim 17 wherein the at least one participant can wager that the house will win or can wager that at least the one player will win.

19. A method according to claim 18 wherein the at least one player is allocated one more die than the house.

20. A method according to claim 17 wherein the at least one participant can wager that the indicia allocated to the house will total at least twenty one.

21. A method according to claim 17 wherein the at least one participant can wager that the indicia allocated to the house will total no more than seven.

22. A method according to claim 17 wherein the at least one participant can separately wager that:

(a) all of the indicia allocated to the house will match, (b) all but one of the indicia allocated to the house will match, (c) all of the indicia allocated to the at least one player will match, or (d) all but one of the indicia allocated to the at least one player will match.

23. A method according to claim 17 wherein the at least one participant can separately wager that the values applied to the indicia allocated to the at least one player after invoking the predetermined devaluation rule, will equal in total the ordinary values applied to the indicia allocated to the house.

24. A method according to claim 22 wherein the at least one player is allocated one more die than the house.

25. A method according to claim 11 employing a betting surface, wherein the at least one participant can wager that the house will win or can wager that at least the one player will win by placing at least one chip at a corresponding location on the betting surface.

26. A method according to claim 11 employing a betting surface, wherein the at least one participant can wager that the indicia allocated to the house will total at least a predetermined sum by placing at least one chip at a corresponding location on the betting surface.

27. A method according to claim 11 employing a betting surface, wherein the at least one participant can wager that the indicia allocated to the house will total no more than a predetermined sum by placing at least one chip at a corresponding location on the betting surface.

28. A method according to claim 11 employing a betting surface, wherein the at least one participant can, by placing at least one chip at a corresponding location on the betting surface, separately wager that:

(a) all of the indicia allocated to the house will match, (b) all but one of the indicia allocated to the house will match, (c) all of the indicia allocated to the at least one player will match, or (d) all but one of the indicia allocated to the at least one player will match.

29. A method according to claim 11 employing a betting surface, wherein the at least one participant can, by placing at least one chip at a corresponding location on the betting surface, separately wager that the values applied to the indicia allocated to the at least one player after invoking the predetermined devaluation rule, will equal in total the ordinary values applied to the indicia allocated to the house.

* * * * *